US011458736B2

(12) United States Patent
Tamai

(10) Patent No.: US 11,458,736 B2
(45) Date of Patent: Oct. 4, 2022

(54) RECORDING DEVICE AND RECORDING METHOD

(71) Applicant: SEIKO EPSON CORPORATION, Tokyo (JP)

(72) Inventor: Takashi Tamai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 29 days.

(21) Appl. No.: 17/215,280

(22) Filed: Mar. 29, 2021

(65) Prior Publication Data

US 2021/0300058 A1 Sep. 30, 2021

(30) Foreign Application Priority Data

Mar. 31, 2020 (JP) ..... JP2020-062274

(51) Int. Cl.
*B41J 2/21* (2006.01)

(52) U.S. Cl.
CPC ..... *B41J 2/2103* (2013.01)

(58) Field of Classification Search
CPC ..... B41J 2/2103
See application file for complete search history.

(56) References Cited

U.S. PATENT DOCUMENTS

| | | | | |
|---|---|---|---|---|
| 9,573,382 | B1 * | 2/2017 | Metcalfe | B41J 2/2121 |
| 2002/0196464 | A1 | 12/2002 | Kodama et al. | |
| 2004/0081371 | A1 | 4/2004 | Nishide et al. | |

FOREIGN PATENT DOCUMENTS

| | | | |
|---|---|---|---|
| JP | 2004-153331 | A | 5/2004 |
| JP | 2006-108967 | A | 4/2006 |
| JP | 2008-193706 | A | 8/2008 |
| JP | 2011-005129 | A | 1/2011 |
| JP | 2018-117216 | A | 7/2018 |

* cited by examiner

*Primary Examiner* — Justin Seo
(74) *Attorney, Agent, or Firm* — Global IP Counselors, LLP

(57) ABSTRACT

A recording device includes a recording unit configured to discharge a plurality of colors of ink, and a control unit configured to control the recording unit to perform recording of an image on a recording medium, wherein the control unit is configured to perform color expansion processing to copy, to a target pixel, a recording amount of first ink included in another pixel, the target pixel and the other pixel configuring image data representing the image, the target pixel being adjacent to the other pixel, the other pixel including the recording amount of the first ink of the plurality of colors of ink, the target pixel including a recording amount of second ink of the plurality of colors of ink, and cause the recording unit to perform recording based on the image data after the color expansion processing. The target pixel does not include the recording amount of the first ink, and the second ink has a different color than the first ink.

4 Claims, 11 Drawing Sheets x → y ↓

| | x0 | x1 | x3 | x4 | x5 | x6 |
|---|---|---|---|---|---|---|
| y0 | 0,0,0,0 | 0,0,0,0 | 0,0,0,0 | 0,0,0,0 | 0,0,0,0 | 0,0,0,0 |
| y1 | 0,0,0,0 | 100,0,0,0 | 100,0,0,0 | 0,80,0,0 | 0,80,0,0 | 0,0,0,0 |
| y2 | 0,0,0,0 | 100,0,0,0 | 100,0,0,0 | 0,80,0,0 | 0,80,0,0 | 0,0,0,0 |
| y3 | 0,0,0,0 | 0,0,40,0 | 0,0,40,0 | 0,0,0,20 | 0,0,0,20 | 0,0,0,0 |
| y4 | 0,0,0,0 | 0,0,40,0 | 0,0,40,0 | 0,0,0,20 | 0,0,0,20 | 0,0,0,0 |
| y5 | 0,0,0,0 | 0,0,0,0 | 0,0,0,0 | 0,0,0,0 | 0,0,0,0 | 0,0,0,0 |

40

FIG. 5A x → y ↓

| | x0 | x1 | x3 | x4 | x5 | x6 |
|---|---|---|---|---|---|---|
| y0 | 0,0,0,0 | 0,0,0,0 | 0,0,0,0 | 0,0,0,0 | 0,0,0,0 | 0,0,0,0 |
| y1 | 0,0,0,0 | 100,0,0,0 | 100,80,0,0 | 100,80,0,0 | 0,80,0,0 | 0,0,0,0 |
| y2 | 0,0,0,0 | 100,0,0,0 | 100,80,0,0 | 100,80,0,0 | 0,80,0,0 | 0,0,0,0 |
| y3 | 0,0,0,0 | 100,0,40,0 | 100,0,40,0 | 0,80,0,20 | 0,80,0,20 | 0,0,0,0 |
| y4 | 0,0,0,0 | 0,0,40,0 | 0,0,40,0 | 0,0,0,20 | 0,0,0,20 | 0,0,0,0 |
| y5 | 0,0,0,0 | 0,0,0,0 | 0,0,0,0 | 0,0,0,0 | 0,0,0,0 | 0,0,0,0 |

40

FIG. 5B

40

40C

| | x0 | x1 | x3 | x4 | x5 | x6 |
|---|---|---|---|---|---|---|
| y0 | 0 | 0 | 0 | 0 | 0 | 0 |
| y1 | 0 | 100 | 100 | 0 | 0 | 0 |
| y2 | 0 | 100 | 100 | 0 | 0 | 0 |
| y3 | 0 | 0 | 0 | 0 | 0 | 0 |
| y4 | 0 | 0 | 0 | 0 | 0 | 0 |
| y5 | 0 | 0 | 0 | 0 | 0 | 0 |

40M

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 80 | 80 | 0 |
| y2 | 0 | 0 | 0 | 80 | 80 | 0 |
| y3 | 0 | 0 | 0 | 0 | 0 | 0 |
| y4 | 0 | 0 | 0 | 0 | 0 | 0 |
| y5 | 0 | 0 | 0 | 0 | 0 | 0 |

40Y

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 40 | 40 | 0 | 0 | 0 |
| y4 | 0 | 40 | 40 | 0 | 0 | 0 |
| y5 | 0 | 0 | 0 | 0 | 0 | 0 |

40K

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 0 | 0 | 20 | 20 | 0 |
| y4 | 0 | 0 | 0 | 20 | 20 | 0 |
| y5 | 0 | 0 | 0 | 0 | 0 | 0 |

FIG. 6

40

40C

| | x0 | x1 | x3 | x4 | x5 | x6 |
|---|---|---|---|---|---|---|
| y0 | 0 | 0 | 0 | 0 | 0 | 0 |
| y1 | 0 | 100 | 100 | 0 | 0 | 0 |
| y2 | 0 | 100 | 100 | 0 | 0 | 0 |
| y3 | 0 | 0 | 0 | 0 | 0 | 0 |
| y4 | 0 | 0 | 0 | 0 | 0 | 0 |
| y5 | 0 | 0 | 0 | 0 | 0 | 0 |

40M

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 80 | 80 | 0 |
| y2 | 0 | 0 | 0 | 80 | 80 | 0 |
| y3 | 0 | 0 | 0 | 0 | 0 | 0 |
| y4 | 0 | 0 | 0 | 0 | 0 | 0 |
| y5 | 0 | 0 | 0 | 0 | 0 | 0 |

40Y

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 40 | 40 | 0 | 0 | 0 |
| y4 | 0 | 40 | 40 | 0 | 0 | 0 |
| y5 | 0 | 0 | 0 | 0 | 0 | 0 |

40K

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 0 | 0 | 20 | 20 | 0 |
| y4 | 0 | 0 | 0 | 20 | 20 | 0 |
| y5 | 0 | 0 | 0 | 0 | 0 | 0 |

FIG. 7

40

40C

| | x0 | x1 | x3 | x4 | x5 | x6 |
|---|---|---|---|---|---|---|
| y0 | 0 | 0 | 0 | 0 | 0 | 0 |
| y1 | 0 | 100 | 100 | 0 | 0 | 0 |
| y2 | 0 | 100 | 100 | 0 | 0 | 0 |
| y3 | 0 | 0 | 0 | 0 | 0 | 0 |
| y4 | 0 | 0 | 0 | 0 | 0 | 0 |
| y5 | 0 | 0 | 0 | 0 | 0 | 0 |

40M

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 80 | 80 | 0 |
| y2 | 0 | 0 | 0 | 80 | 80 | 0 |
| y3 | 0 | 0 | 0 | 0 | 0 | 0 |
| y4 | 0 | 0 | 0 | 0 | 0 | 0 |
| y5 | 0 | 0 | 0 | 0 | 0 | 0 |

40Y

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 40 | 40 | 0 | 0 | 0 |
| y4 | 0 | 40 | 40 | 0 | 0 | 0 |
| y5 | 0 | 0 | 0 | 0 | 0 | 0 |

40K

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 0 | 0 | 20 | 20 | 0 |
| y4 | 0 | 0 | 0 | 20 | 20 | 0 |
| y5 | 0 | 0 | 0 | 0 | 0 | 0 |

FIG. 8

40

40C

| | x0 | x1 | x3 | x4 | x5 | x6 |
|---|---|---|---|---|---|---|
| y0 | 0 | 0 | 0 | 0 | 0 | 0 |
| y1 | 0 | 100 | 100 | 100 | 0 | 0 |
| y2 | 0 | 100 | 100 | 100 | 0 | 0 |
| y3 | 0 | 100 | 100 | 0 | 0 | 0 |
| y4 | 0 | 0 | 0 | 0 | 0 | 0 |
| y5 | 0 | 0 | 0 | 0 | 0 | 0 |

40M

| | x0 | x1 | x3 | x4 | x5 | x6 |
|---|---|---|---|---|---|---|
| y0 | 0 | 0 | 0 | 0 | 0 | 0 |
| y1 | 0 | 0 | 80 | 80 | 80 | 0 |
| y2 | 0 | 0 | 80 | 80 | 80 | 0 |
| y3 | 0 | 0 | 0 | 80 | 80 | 0 |
| y4 | 0 | 0 | 0 | 0 | 0 | 0 |
| y5 | 0 | 0 | 0 | 0 | 0 | 0 |

40Y

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 40 | 40 | 0 | 0 | 0 |
| y4 | 0 | 40 | 40 | 0 | 0 | 0 |
| y5 | 0 | 0 | 0 | 0 | 0 | 0 |

40K

| | x0 | x1 | x3 | x4 | x5 | x6 |
|---|---|---|---|---|---|---|
| y0 | 0 | 0 | 0 | 0 | 0 | 0 |
| y1 | 0 | 0 | 0 | 0 | 0 | 0 |
| y2 | 0 | 0 | 0 | 0 | 0 | 0 |
| y3 | 0 | 0 | 0 | 20 | 20 | 0 |
| y4 | 0 | 0 | 0 | 20 | 20 | 0 |
| y5 | 0 | 0 | 0 | 0 | 0 | 0 |

FIG. 9

RECORDING DEVICE AND RECORDING METHOD

The present application is based on, and claims priority from JP Application Serial Number 2020-062274, filed Mar. 31, 2020, the disclosure of which is hereby incorporated by reference herein in its entirety.

BACKGROUND

1. Technical Field

The present disclosure relates to a recording device.

2. Related Art

A printing device is disclosed that has a printing unit that applies UV (Ultra violet) ink, which is ultra violet light curable ink, to a substrate, and a light irradiation unit that irradiates the UV ink applied by the printing unit with light (refer to JP-A-2011-51299).

There is a recording form in which ink does not easily penetrate or bleed through the recording medium, such as when the UV ink is recorded in the recording medium. In such a case, a phenomenon occurs in which the color appears to be thin at a color boundary portion where dots of ink of different colors are adjacent to each other on the recording medium. Specifically, a film thickness of the dot discharged onto the recording medium is thick at the center portion of the dot, and thin at the edge portion of the dot. Thus, the above-mentioned color boundary portion, in which the edge portions of the dot having a thin film thickness are adjacent to each other, appears to be thin due to the color of the recording medium being transparent, for example. As a result, the color boundary portion is visible as color unevenness in a recording image. Also, the reduction in image quality due to the thin color boundary portion in the recording result may occur without limitation to a scene using the UV ink.

SUMMARY

A recording device includes a recording unit configured to discharge a plurality of colors of ink, and a control unit configured to control the recording unit to perform recording of an image on a recording medium, wherein the control unit is configured to perform color expansion processing to copy, to a target pixel, a recording amount of first ink included in another pixel, the target pixel and the other pixel configuring image data representing the image, the target pixel being adjacent to the other pixel, the other pixel including the recording amount of the first ink of the plurality of colors of ink, the target pixel including a recording amount of second ink of the plurality of colors of ink, and cause the recording unit to perform recording based on the image data after the color expansion processing, and the target pixel does not include the recording amount of the first ink, and the second ink has a different color than the first ink.

A recording method for performing recording of an image on a recording medium by controlling a recording unit configured to discharge a plurality of colors of ink includes a color expansion step for copying, to a target pixel, a recording amount of first ink included in another pixel, the target pixel and the other pixel configuring image data representing the image, the target pixel being adjacent to the other pixel, the other pixel including the recording amount of the first ink of the plurality of colors of ink, the target pixel including a recording amount of second ink of the plurality of colors of ink, and a recording step for causing the recording unit to perform recording based on the image data after the color expansion step, wherein the target pixel does not include the recording amount of the first ink, and the second ink has a different color than the first ink.

BRIEF DESCRIPTION OF THE DRAWINGS

FIG. 5A is a diagram illustrating an example of image data before color expansion processing, and FIG. 5B is a diagram illustrating an example of image data after the color expansion processing.

FIG. 6 is a diagram illustrating a state in which the image data before the color expansion processing is decomposed into plates for each ink color.

FIG. 7 is a diagram simply illustrating the pixels extracted as expansion original pixels by step S122.

FIG. 8 is a diagram simply illustrating the pixels extracted as target pixels by step S124.

FIG. 9 is a diagram illustrating a state in which step S125 has been performed at the target pixel.

DESCRIPTION OF EXEMPLARY EMBODIMENTS

Hereinafter, exemplary embodiments of the present disclosure will be described below with reference to the accompanying drawings. Note that each of the drawings is merely illustrative for describing the present embodiment. Because the drawings are exemplary, the proportions and shapes may not be precise, match each other, or some may be omitted.

1. GENERAL DESCRIPTION OF DEVICE

Figure 1:
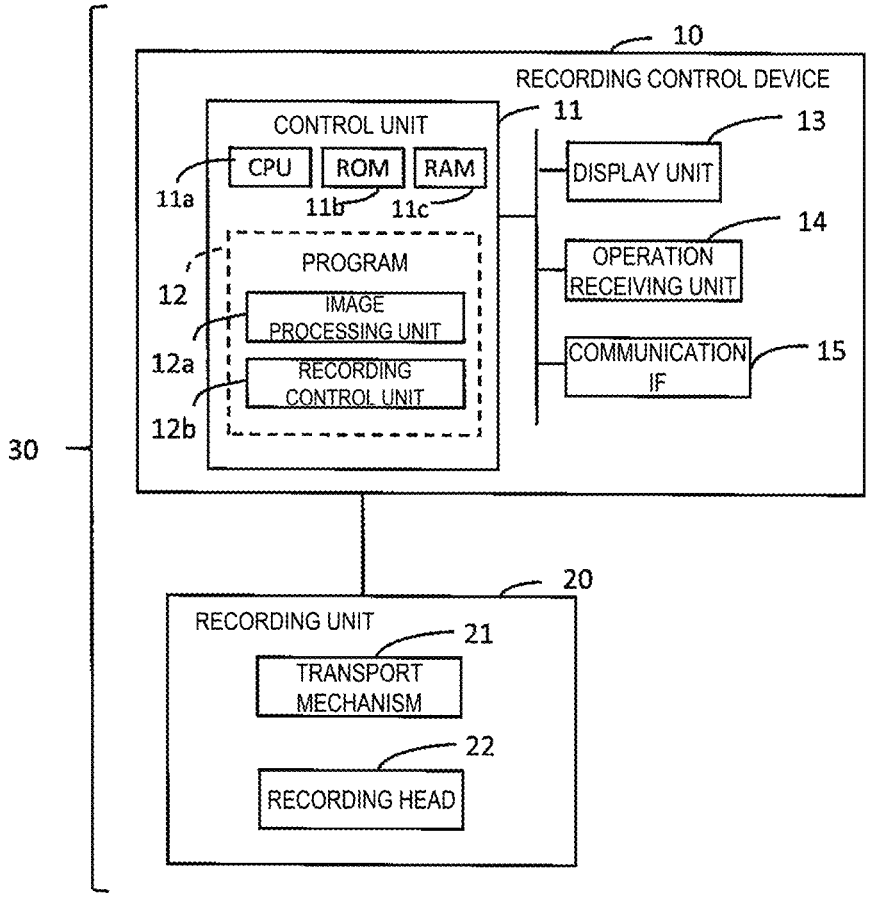
FIG. 1 is a block diagram illustrating a simple device configuration.

FIG. 1 simply illustrates a configuration of a system 30 according to the present embodiment. The system 30 includes a recording control device 10 and a recording unit 20. The system 30 may be referred to as a recording system, an image processing system, a printing system, etc. A recording method is realized by at least a portion of the system 30.

The recording control device 10 is realized by, for example, a personal computer, a server, a smartphone, a tablet terminal, or an information processing device having the same degree of processing capability thereof. The recording control device 10 includes a control unit 11, a display unit 13, an operation receiving unit 14, a communication interface 15, etc. The interface is abbreviated as IF. The control unit 11 is configured to include one or more ICs having CPU 11*a* as a processor, ROM 11*b*, RAM 11*c*, etc., as well as other non-volatile memory, etc.

In the control unit 11, the processor, i.e., CPU 11*a*, performs arithmetic processing in accordance with a program stored in ROM 11*b* or other memory, using RAM 11*c*, etc. as a work area. The control unit 11 performs processing according to the program 12 to perform various functions, such as an image processing unit 12*a* and a recording control unit 12*b*, in cooperation with the program 12. The program 12 may be referred to as an image processing program, a recording control program, a print control program, etc. The processor is not limited to a single CPU, and may be a configuration in which the processing is performed by a hardware circuit such as a plurality of CPUs, an ASIC, etc., or a configuration in which the CPU and the hardware circuit cooperate to perform the processing.

The display unit 13 is a means for displaying visual information, and is configured, for example, by a liquid crystal display, an organic EL display, etc. The display unit 13 may be configured to include a display and a driving circuit for driving the display. The operation receiving unit 14 is a means for receiving an operation by a user, and is realized, for example, by a physical button, a touch panel, a mouse, a keyboard, etc. Needless to exemplify, the touch panel may be realized as a function of the display unit 13. The display unit 13 and the operation receiving unit 14 can be referred to as an operating panel of the recording control device 10.

The display unit 13 and the operation receiving unit 14 may be portions of the configuration of the recording control device 10, while may be peripheral devices external to the recording control device 10. The communication IF 15 is a generic term for one or more IFs that allow the recording control device 10 to perform wired or wireless communication with the outside according to a prescribed communication protocol including a known communication standard. The control unit 11 communicates with the recording unit 20 via the communication IF 15.

The recording unit 20 performs recording on the recording medium under control by the recording control device 10. The recording unit 20 may be referred to as a printer 20. The recording unit 20 performs recording by discharging a plurality of colors of ink such as cyan (C), magenta (M), yellow (Y), and black (K), for example, by an ink jet method. The recording unit 20 generally includes a transport mechanism 21 and recording heads 22. A specific example of the recording unit 20 will be described later using FIG. 2.

The recording control device 10 and the recording unit 20 may be coupled through a network (not illustrated). The recording unit 20 may be a composite machine having a plurality of functions such as a scanner function and a facsimile communication function in addition to the printing function. The recording control device 10 may be realized by one independent information processing device, but may also be realized by a plurality of information processing devices communicatively coupled to each other via a network.

Alternatively, the recording control device 10 and the recording unit 20 may be a recording device in which they are integrated. In other words, the system 30 may be a single recording device 30 including the recording control device 10 and the recording unit 20 as actual reality. Accordingly, the processing performed by the recording control device 10 described below may be interpreted as processing performed by the recording device 30.

Figure 2:
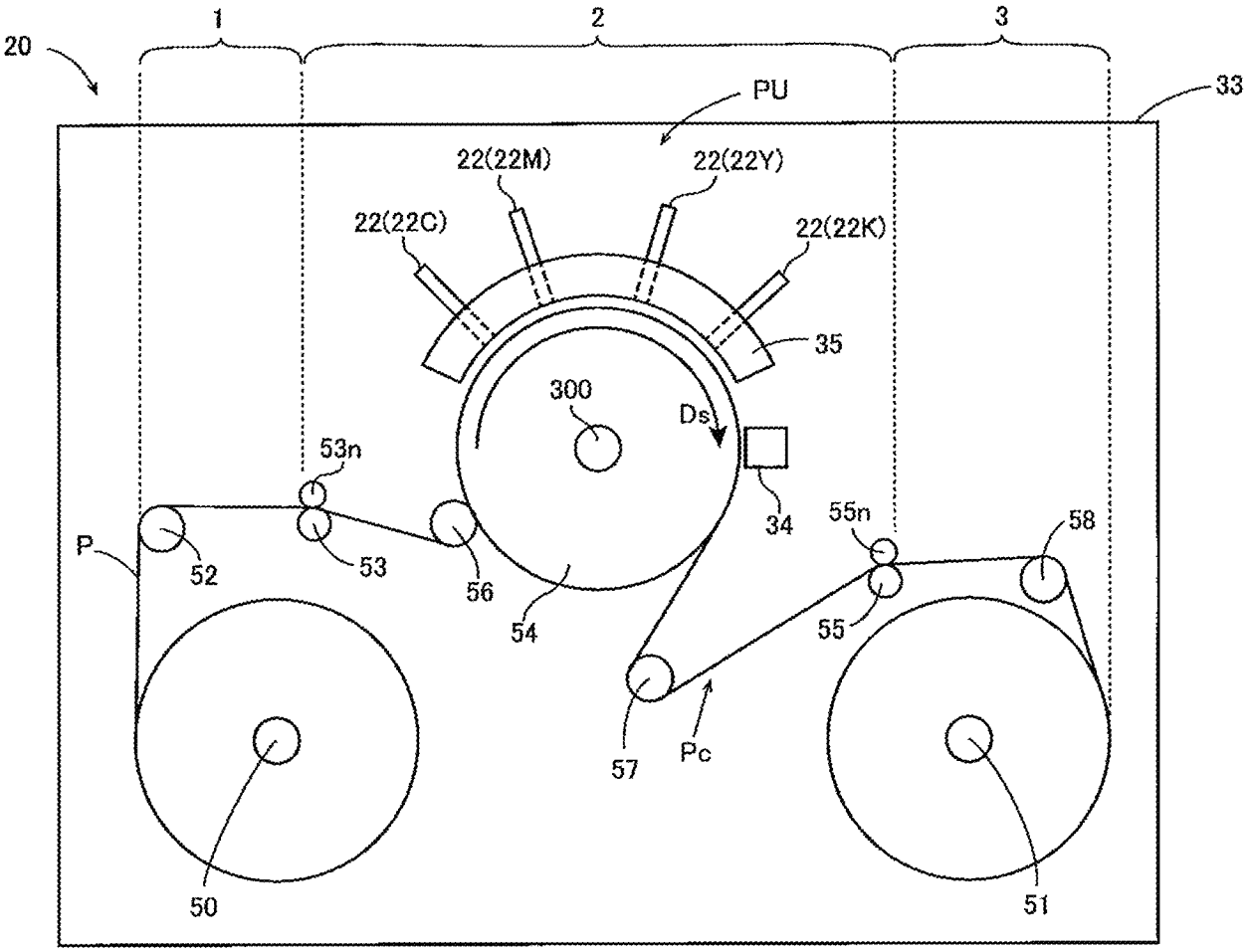
FIG. 2 is a diagram illustrating a simple configuration of a recording unit.

FIG. 2 illustrates a configuration of the recording unit 20. The recording unit 20 includes a feeding shaft 50 and a winding shaft 51. A single sheet P wound in a roll shape around the feeding shaft 50 and the winding shaft 51 is tensioned along a transport path Pc. The sheet P is a recording medium. The sheet P is transported from the feeding shaft 50 in a transport direction Ds toward the winding shaft 51 while recording is performed. The transport direction Ds is a direction along the transport path Pc.

In the example illustrated in FIG. 2, the transport path Pc is formed by combining a plurality of straight lines and curved lines, and thus the transport direction Ds is different at each position of the transport path Pc. The sheet P may be paper or a medium of, for example, a resin based material other than paper. The recording unit 20 includes a feeding portion 1 configured to feed the sheet P from the feeding shaft 50, a process portion 2 configured to record the sheet P fed from the feeding portion 1, and a winding unit 3 configured to wind the sheet P recorded by the process portion 2 around the winding shaft 51. The feeding portion 1, the process portion 2, and the winding unit 3 are arranged from left to right in FIG. 2, and housed in a housing 33 of the recording unit 20. In the transport path Pc, the feeding portion 1 is located upstream with respect to the process portion 2 and the winding unit 3. Further, in the transport path Pc, the winding unit 3 is located downstream with respect to the feeding portion 1 and the process portion 2. Hereinafter, the upstream and downstream of the transport path Pc are simply designated as upstream and downstream.

The feeding portion 1 has the feeding shaft 50 and a driven roller 52 on which the sheet P drawn out from the feeding shaft 50 is wound. When the feeding shaft 50 is rotated clockwise on the paper surface of FIG. 2, the sheet P wound around the feeding shaft 50 is fed to the process portion 2 via the driven roller 52. While supporting the sheet P fed from the feeding portion 1 by means of a rotating drum 54, the process portion 2 appropriately performs processing by a process unit PU arranged along an outer circumferential surface of the rotating drum 54, to record an image on the sheet P. In the process portion 2, a front driving roller 53 is provided at an upstream position of the rotating drum 54, and a rear driving roller 55 is provided at a downstream position of the rotating drum 54. The sheet P is transported from the front driving roller 53 to the rear driving roller 55. The sheet P is supported by the rotating drum 54.

The front driving roller 53 is rotated clockwise on the paper surface of FIG. 2 to transport the sheet P fed from the feeding portion 1 to the downstream. A nip roller 53*n* is provided for the front driving roller 53. The nip roller 53*n* abuts on the sheet P to sandwich the sheet P between the nip roller 53*n* and the front driving roller 53.

The rotating drum 54 is a cylindrical drum having a center line in a direction perpendicular to the paper surface of FIG. 2. In the example illustrated in FIG. 2, the rotating drum 54 corresponds to a support portion that supports the recording medium. In addition, the rotating drum 54 has a rotational movement shaft 300 extending in an axis direction along the central line of the cylindrical shape thereof. The rotational movement shaft 300 is rotatably supported by a support mechanism (not illustrated). The rotating drum 54 is rotated about the rotational movement shaft 300. The sheet P transported from the front driving roller 53 to the rear driving roller 55 is wound around the outer circumferential surface of this rotating drum 54. While receiving frictional force between the rotating drum 54 and the sheet P to be driven to rotate in the transport direction Ds of the sheet P, the rotating drum 54 supports the sheet P.

The process portion 2 is provided with driven rollers 56, 57 that fold back the sheet P at both ends of the range of the sheet P wound on the rotating drum 54. The driven roller 56 winds the sheet P between the front driving roller 53 and the rotating drum 54 to fold back the sheet P. The driven roller 57 winds the sheet P between the rotating drum 54 and the rear driving roller 55 to fold back the sheet P. The sheet P is folded back at each position upstream and downstream of the rotating drum 54 in such a manner, which allows the range of winding around the rotating drum 54 of the sheet P to be kept with a long range.

The rear driving roller 55 winds the sheet P that has been transported from the rotating drum 54 via the driven roller 57. In addition, the rear driving roller 55 is rotated clockwise on the paper surface of FIG. 2 to transport the sheet P to the winding unit 3. A nip roller 55*n* is provided for the rear driving roller 55. The nip roller 55*n* abuts on the sheet P to sandwich the sheet P between the nip roller 55*n* and the rear driving roller 55.

The process unit PU includes the recording heads 22 and a UV irradiator 34. When distinguishing between the individual recording heads 22, reference signs 22C, 22M, 22Y, and 22K are used as appropriate. The process unit PU also includes a carriage 35. The recording heads 22C, 22M, 22Y, and 22K are mounted on the carriage 35. The plurality of recording heads 22 and the UV irradiator 34 are arranged along the outer circumference of the rotating drum 54 to face the outer circumferential surface of the rotating drum 54. For example, the recording heads 22C, 22M, 22Y, and 22K correspond to ink of C, M, Y, and K in this order. Ink with a corresponding color can be discharged by the ink jet method. The recording heads 22 have a plurality of nozzles (not illustrated) on an opposing surface facing the outer circumferential surface of the rotating drum 54, and discharge or do not discharge the ink from the nozzles based on recorded data. The ink discharged by the nozzle corresponds to an ink droplet and referred to as a dot. The recording heads 22 may be referred to as print heads, ink jet heads, liquid discharging heads, etc. Each of the recording heads 22 discharges ink, which results in a color image recorded in the sheet P supported by the rotating drum 54.

As each color ink used by the recording heads 22, UV ink is used, which is cured by undergoing irradiation with ultra violet light The UV irradiator 34 is provided to cure the ink that has landed on the sheet P and to fix the ink on the sheet P. The UV irradiator 34 emits ultra violet light from the opposing surface facing the outer circumferential surface of the rotating drum 54. In the example of FIG. 2, the UV irradiator 34 is arranged downstream from each recording head 22. Accordingly, each ink of CMYK discharged from the recording heads 22C, 22M, 22Y, and 22K onto the sheet P is cured by receiving ultra violet light from the UV irradiator 34.

Taking into account the operability of winding the sheet P around the rotating drum 54, maintenance of the recording heads 22, etc, the carriage 35 is, along a guide rail (not illustrated) extending in a direction perpendicular to the paper surface of FIG. 2, configured to be movable in the foregoing direction. The plurality of recording heads 22 mounted on the carriage 35 may be collectively regarded as one recording head for performing color printing. The UV irradiator 34 may also be mounted on the carriage 35. A plurality of UV irradiators 34 may be present. The sheet P recorded by the process portion 2 is transported to the winding unit 3 by the rear driving roller 55. In addition to the winding shaft 51 around which the end of the sheet P is wound, the winding unit 3 has a driven roller 58 that winds the sheet P between the winding shaft 51 and the rear driving roller 55. When the winding shaft 51 is rotated clockwise on the paper surface of FIG. 2, the sheet P transported from the rear driving roller 55 is wound around the winding shaft 51 via the driven roller 58.

The feeding shaft 50, the winding shaft 51, the rotating drum 54, and each roller, as well as motors (not illustrated) for appropriately rotating these rollers, are specific examples of the transport mechanism 21 that transports the sheet P. The number and arrangement of the rollers provided in the middle of the transport path Pc for transporting the sheet P are not limited to the aspect illustrated in FIG. 2. Additionally, the color of the ink used by the process portion 2 for recording is not limited to the color described above. Needless to exemplify, the recording unit 20 may be configured to linearly transport the sheet P in a state of being supported by a flat platen etc. rather than by the rotating drum 54 with a cylindrical shape. In this case, each of the recording heads 22 for each ink color and the UV irradiator 34 are arranged along the linear transport direction. The sheet P is discharged with ink of each color and irradiated with the ultra violet light.

2. DESCRIPTION OF RECORDING METHOD

Figure 3:
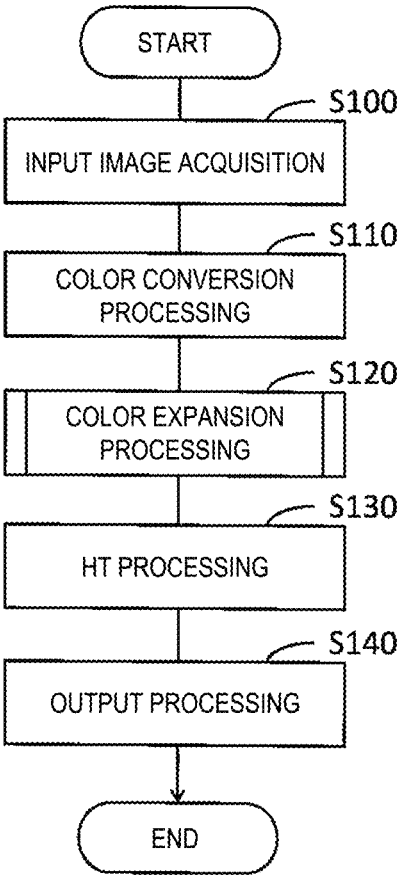
FIG. 3 is a flowchart illustrating recording control processing.

FIG. 3 illustrates, in a flowchart, recording control processing performed by the control unit 11 in accordance with the program 12. The recording method according to the present embodiment is realized by this recording control processing.

The control unit 11 starts the recording control processing triggered by receiving a recording instruction on an input image. In step S100, the image processing unit 12*a* acquires the input image. The user optionally selects the input image by manipulating the operation receiving unit 14 while viewing a UI screen displayed on the display unit 13, and performs the recording instruction on the input image. The UI is an abbreviation for user interface. The control unit 11 acquires the input image thus selected from a storage source such as a predetermined memory.

The input image acquired in step S100 is image data in a bitmap format defining the color of each pixel in a predetermined color coordinate system. The predetermined color coordinate system referred to here means, for example, RGB (red, green, blue) color coordinate system, CMYK color coordinate system, XYZ color coordinate system, L' a' b' color coordinate system, etc. The image processing unit 12*a* may perform resolution conversion processing as necessary to match the respective vertical and horizontal resolutions of the input image to the respective vertical and horizontal recording resolutions by the recording unit 20.

In step S110, the image processing unit 12*a* performs color conversion processing on the input image. In other words, the color coordinate system of the input image is converted to the color coordinate system of the ink used by the recording unit 20 for recording. For example, as described above, when the recording unit 20 is a type using the CMYK ink and the image data of the input image has a gradation value for each RGB for each pixel, the image processing unit 12*a* converts the gradation value of RGB to a gradation value of CMYK for each pixel of the image data. The gradation value is a value in a 256 gradation range of 0-255, for example. The color conversion processing can be performed by referring to any color conversion look-up table defining a conversion relationship from RGB to CMYK. The gradation value for each CMYK included in each pixel of the image data after the color conversion processing represents a recording amount of ink for each CMYK.

In step S120, the image processing unit 12*a* performs color expansion processing on the image data after the color conversion processing. The color expansion processing is a process for copying, to a target pixel, a recording amount of first ink included in another pixel, wherein the target pixel is adjacent to the other pixel, does not include the recording amount of the first ink, and includes a recording amount of second ink different from the first ink. Step S120 corresponds to a color expansion step.

Figure 4:
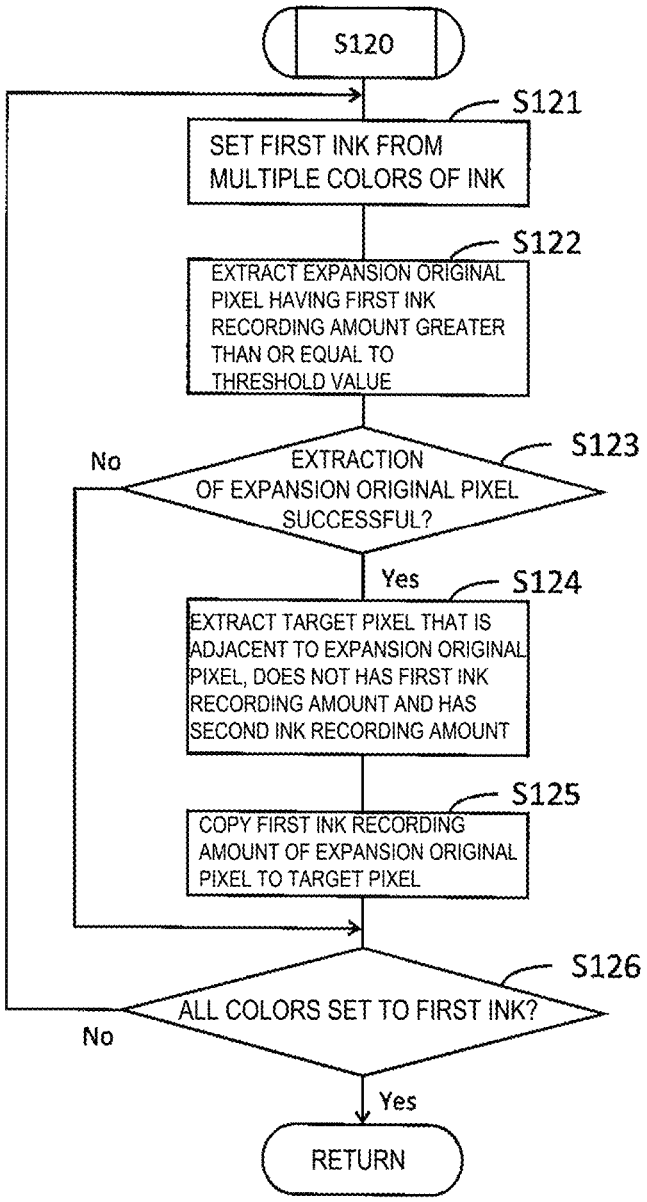
FIG. 4 is a flowchart illustrating details of step S120.

FIG. 4 illustrates in flow chart details of step S120.

In step S121, the image processing unit 12*a* sets the first ink from the plurality of colors of ink. In the present embodiment, the "first ink" means a single color ink of the plurality of colors of ink used by the recording unit 20. The "second ink" means ink other than the first ink of the plurality of colors of ink used by the recording unit 20. Thus, in step S121, when the C ink among the CMYK ink, for example, is set to the first ink, each of the MYK ink corresponds to the second ink. Additionally, in step S121, when the M ink among the CMYK ink is set to the first ink, each of the CYK ink corresponds to the second ink.

Here, step S122 and subsequent processing will be described assuming that the C ink is set to the first ink.

In step S122, the image processing unit 12*a* extracts, from among the pixels configuring the image data, a pixel having a recording amount of the first ink that is equal to or greater than a predetermined threshold value. That is, a pixel with the gradation value of C that is greater than or equal to the predetermined threshold value is extracted. The pixel extracted in step S122 corresponds to an "expansion original pixel". The threshold value used in step S122 is preset. Alternatively, the threshold value may have a different value set for each color of the first ink.

In step S123, the image processing unit 12*a* determines whether or not the extraction of the expansion original pixel by step S122 has been successful. When the image processing unit 12*a* is capable of extracting one or more expansion original pixels in step S122, the image processing unit 12*a* proceeds to step S124 from the determination of "Yes" in step S123. On the other hand, when none of the expansion original pixels can be extracted in step S122, the processing proceeds to step S126 from the determination of "No" in step S123.

In step S124, the image processing unit 12*a* extracts, from among the pixels configuring the image data, a pixel, which is adjacent to the expansion original pixel extracted in step S122, does not have the recording amount of the first ink, and has the recording amount of the second ink. That is, a pixel is extracted, which is adjacent to the expansion original pixel, where the gradation value of C is 0 and the gradation value of at least one color of the MYK is greater than 0. The pixel extracted in step S124 corresponds to the "target pixel".

In step S125, the image processing unit 12*a* copies the recording amount of the first ink included in the expansion original pixel to the target pixel in the relationship between the adjacent expansion original pixel and the target pixel. In other words, a recording range of the first ink is expanded from the expansion original pixel to the target pixel.

In step S126, the image processing unit 12*a* determines whether or not the entire color ink used by the recording unit 20 has been set to the first ink in step S121. When the entire color ink is set to the first ink in step S121, step S120 is ended in the determination of "Yes" in step S126 and the processing proceeds to step S130. On the other hand, when an ink color that has been not set to the first ink remains, the processing returns to step S121 from the determination of "No" in step S126. When the image processing unit 12*a* has not set the first ink for the MYK ink, for example, at the time of the determination in step S126, the image processing unit 12*a* proceeds to step S121, wherein any one of these MYK colors is set to the first ink, and the steps S122 and the subsequent steps are performed.

Again, with reference to FIG. 3, the description is continued.

In step S130, the image processing unit 12*a* generates the recorded data by performing halftone processing on the image data after the color expansion processing. The halftone is abbreviated as HT. The specific technique of the HT processing can be performed by any method, wherein a dithering method, an error diffusion method, etc. can be employed. The HT processing generates the recorded data defining the discharge (dot-on) or non-discharge (dot-off) for each ink dot in CMYK for each pixel. Needless to exemplify, the information of the dot-on in the recorded data may be information defining which of a plurality of types of dots having different sizes, for example, large dots, medium dots, and small dots, are to be discharged. The recorded data after the HT processing also corresponds to the image data after the color expansion processing.

In step S140, the recording control unit 12*b* performs output processing to cause the recording unit 20 to perform recording based on the recorded data generated in step S130. The recording control unit 12*b* transfers the recorded data to the recording unit 20, thereby causing the recording unit 20 to perform recording based on the recorded data. The recording unit 20 that receives the transfer of the recorded data starts control of the transport mechanism 21 and the recording heads 22, and drives the recording heads 22 based on the recorded data, thereby recording the image represented by the recorded data to the sheet P transported by the transport mechanism 21. Step S140 corresponds to a recording step that causes the recording unit 20 to perform recording based on the image data after the color expansion step.

The color expansion processing of step S120 will be described with reference to the specific example in FIGS. 5-9.

FIG. 5A illustrates a portion of the image data 40 prior to the color expansion processing. Each rectangle configuring the image data 40 corresponds to each pixel of the image data 40. For convenience of explanation, with respect to the image data 40, the lateral direction corresponds to the x direction, the vertical direction corresponds to the y direction, and the position of the pixel is indicated by the xy coordinates. The numerical values set forth in the pixels of the image data 40 are gradation values of each of C, M, Y, and K. For example, the pixels of (x, y)=(x3, y1) are (C, M, Y, K)=(100, 0, 0, 0).

FIG. 6 illustrates the image data 40 illustrated in FIG. 5A as being decomposed into plates for each ink color. In other words, image data 40C in FIG. 6 has gradation values of C for each pixel of the image data 40. Similarly, the image data 40M has gradation values of M for each pixel of the image data 40, the image data 40Y has gradation values of Y for each pixel of the image data 40, and the image data 40K has gradation values of K for each pixel of the image data 40.

Similar to FIG. 6, FIG. 7 illustrates the image data 40 illustrated in FIG. 5A as being decomposed into plates for each ink color. Furthermore, in FIG. 7, the pixels extracted as the expansion original pixels by step S122 are subjected to a gray color for clarity. In this manner, the gray color subjected to some pixels in FIGS. 7-9 does not represent the color of the pixel. Each pixel with C=100 in the image data 40C of FIG. 7 is extracted as the expansion original pixel at step S122 when the C ink is set to the first ink. Similarly, each pixel with M=80 in the image data 40M of FIG. 7 is extracted as the expansion original pixel at step S122 when the M ink is set to the first ink.

In the image data 40Y and the image data 40K in FIG. 7, the expansion original pixel is not extracted. That is, in the example of FIG. 7, each pixel with Y=40 in the image data 40Y is not extracted in step S122 when the Y ink is the first ink, due to having the gradation value of Y less than the threshold value. Similarly, in the example of FIG. 7, each pixel with K=20 in image data 40K is not extracted at step S122 when the K ink is the first ink, due to having the gradation value of K less than the threshold value. Accordingly, in the example of FIGS. 5-9, when the Y ink or K ink is set to the first ink, the expansion original pixel is not extracted in step S122, and then steps S124 and S125 are skipped.

Similar to FIGS. 6, 7, FIG. 8 illustrates the image data 40 illustrated in FIG. 5A as being decomposed into plates for each ink color. Furthermore, in FIG. 8, the pixels extracted as the target pixels in step S124 are subjected to a gray color for clarity. Each pixel with the gray color in the image data 40C in FIG. 8 is adjacent to the expansion original pixel with C=100, has C=0, and the gradation value of at least one color of the MYK is not 0. Therefore, the pixel is extracted as the target pixel in step S124 when the C ink is set to the first ink. Similarly, each pixel with the gray color in the image data 40M of FIG. 8 is adjacent to the expansion original pixel with M=80, has M=0, and the gradation value of at least one color of the CYK is not 0. Therefore, the pixel is extracted as the target pixel in step S124 when the M ink is set to the first ink. In the present embodiment, being "adjacent" to a pixel means being adjacent to a positive side or a negative side in the x direction, or to a positive side or a negative side in the y direction.

Similar to FIGS. 6-8, FIG. 9 illustrates the image data 40 as being decomposed into plates for each ink color. Furthermore, FIG. 9 illustrates a state in which step S125 has been performed at the target pixel. In other words, as can be seen from the comparison of FIG. 8 and FIG. 9, when the C ink is set to the first ink, the gradation value C=100 included in the adjacent expansion original pixel is copied to the target pixel in the image data 40C by step S125. For example, in the image data 40C, in the relationship between the pixel of (x, y)=(x3, y1), which is the expansion original pixel, and the pixel of (x, y)=(x4, y1), which is the target pixel adjacent thereto, the graduation value of C of the expansion original pixel is copied to the target pixel. Similarly, as can be seen from the comparison of FIG. 8 and FIG. 9, when the M ink is set to the first ink, the gradation value M=80 included in the adjacent expansion original pixel is copied to the target pixel in the image data 40M by step S125.

FIG. 5B illustrates a portion of the image data 40 after the color expansion processing. In other words, FIG. 5B illustrates a state in which all of the image data 40C, 40M, 40Y, and 40K that has been decomposed into plates for each ink color in FIG. 9 are overlapped. The image data 40 illustrated in FIG. 5B is subject to the processing of step S130.

Figure 10A:
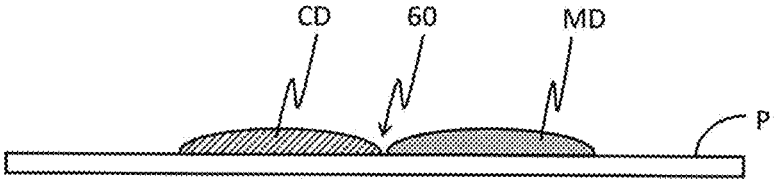
FIG. 10A is a diagram for describing a problem.

FIG. 10A is a diagram for explaining a problem assumed by the present embodiment. In accordance with FIG. 10A, the sheet P is formed with dots of the UV ink of different colors adjacent to each other based on the recorded data generated by the user from the input image selected as desired. Specifically, in the sheet P, a dot CD of the C ink and a dot MD of the M ink are adjacent to each other. A color boundary portion 60 thereof is formed. Although omitted in FIG. 10A, a number of dots of the C ink are continuous to the left of the dot CD, and a number dots of the M ink are continuous to the right of the dot MD in FIG. 10A. Since the film thickness of each of the dots CD, MD discharged onto the sheet P is thick at the center portion of the dot and thin at the edge portion of the dot, so that the color boundary portion 60 appears relatively to be thin in color.

Figure 10B:
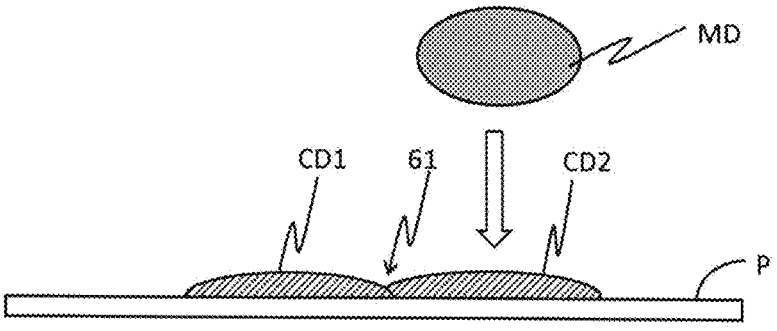
FIG. 10B is a diagram for describing the effects of the present embodiment.

FIG. 10B is a diagram for explaining the effects of the present embodiment. FIG. 10B describes a difference from the description of FIG. 10A. A dot CD1 of the C ink and a dot MD of the M ink illustrated in FIG. 10B may be understood as dots CD, MD illustrated in FIG. 10A. As an interpretation in FIG. 10B, a pixel at a position corresponding to the dot CD1 is considered as the expansion original pixel when the C ink is used as the first ink, and a pixel at a position corresponding to the dot MD is considered as the target pixel adjacent to this expansion original pixel. In this case, in step S125, the recording amount of the C ink of the expansion original pixel is copied to the target pixel. As a result of the HT processing, a dot CD2 of the C ink is discharged to the position corresponding to the dot MD.

The dot CD1 and the dot CD2 are discharged substantially simultaneously onto the sheet P by the recording head 22C. Therefore, even in an environment where the ink does not easily penetrate or bleed through the recording medium, the dot CD1 and the dot CD2, which are of the same color and adjacent to each other, are connected to each other in the processing from the time they land on the sheet P until they are fixed, which results in blurring the boundary thereof. Further, a film with a certain film thickness is formed at a boundary 61 of each other. For such a circumstance, the dot MD is discharged by the recording head 22M at the position overlapping the dot CD 2. Since the boundary 61 between the dot CD1 and the dot CD2 has a certain film thickness formed, the phenomenon of appearing to be thin, as in the color boundary portion 60 in FIG. 10A, is eliminated at the color boundary portion between the dot CD 1 and the dot MD. This improves color unevenness, caused by the color boundary portion 60 between the first ink dot and the second ink dot appearing to be thin, in the present embodiment.

Although the description is omitted in FIG. 10B, in a case where a pixel at a position corresponding to the dot MD is considered as the expansion original pixel when the M ink is used as the first ink, and where a pixel at a position corresponding to the dot CD1 is considered as the target pixel adjacent to this expansion original pixel, the dot of the M ink may also be discharged at the position corresponding to the dot CD1, according to the present embodiment.

3. ADDITIONAL DESCRIPTION OF COLOR EXPANSION PROCESSING

In step S122, the image processing unit 12*a* may not make a determination using the threshold value, and may simply extract a pixel having the recording amount of the first ink as the expansion original pixel. That is, step S122 may simply extract a pixel in which the gradation value of the first ink is not 0 as the expansion original pixel. According to such a configuration, when the Y ink and the K ink are set to the first ink, each pixel having the gradation values of Y=40 and K=20 illustrated in FIG. 5A etc. is extracted as the expansion original pixel in step S122.

In step S125, the image processing unit 12*a* may copy a portion, rather than all, of the recording amount of the first ink included in the expansion original pixel to the adjacent target pixel. This suppresses, as much as possible, the color of the recording result from deviating from the color originally represented by the input image. For example, ½ or ¼ of the recording amount of the first ink included in the expansion original pixel is copied to the target pixel. Specifically, as illustrated in FIG. 8,9, when the gradation value C=100 of the pixel of (x, y)=(x3, y1), which is the expansion original pixel in the image data 40C, is copied to the pixel of the (x, y)=(x4, y1), which is target pixel adjacent thereto, the image processing unit 12*a* may copy half the recording amount, the gradation value C=50, to the target pixel.

Figure 11:
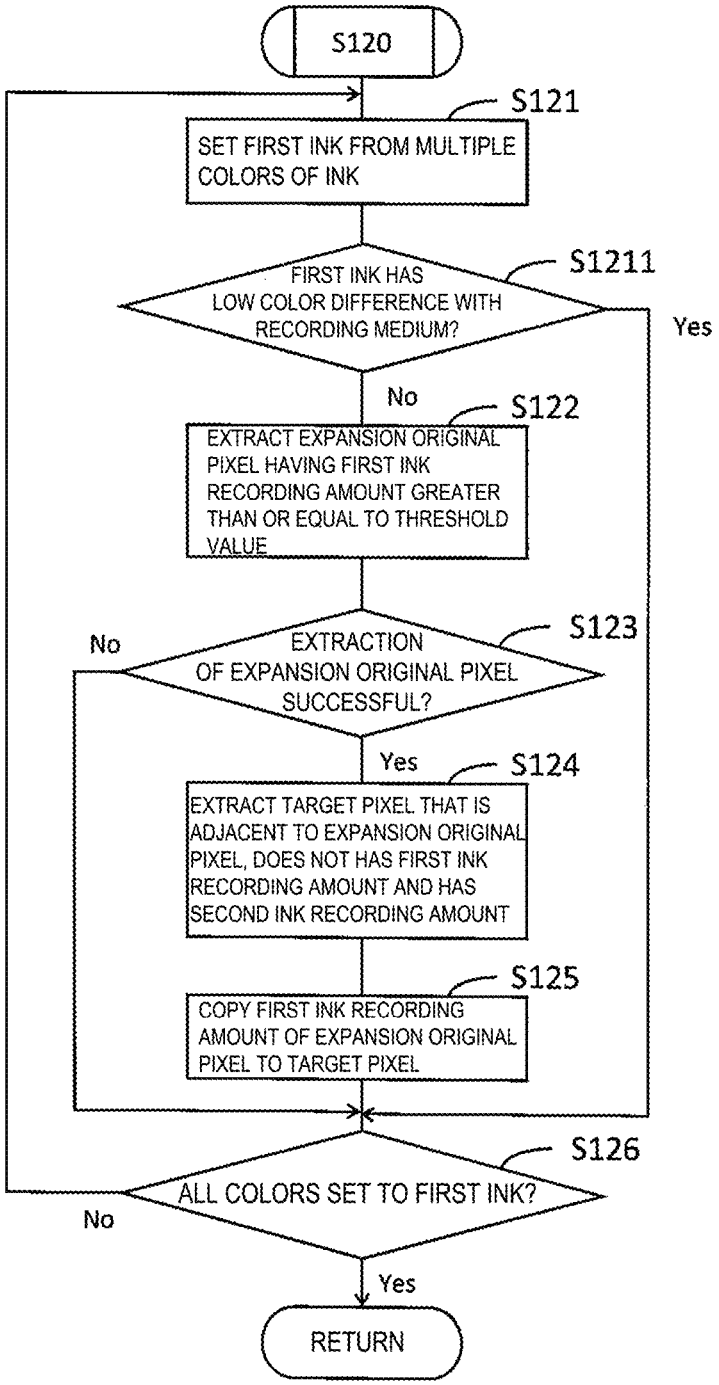
FIG. 11 is a flowchart illustrating details of step S120 and different from FIG. 4.

FIG. 11 is a detail of step S120, with a flowchart illustrating an example different from that of FIG. 4. FIG. 11 differs from FIG. 4 in that step S1211 is performed after step S121. In step S1211, the image processing unit 12*a* determines whether or not the first ink set in step S121 is a color with a small color difference with the recording medium.

The control unit 11 has information in advance of reference values for colors of each of the CMYK ink that may be configured as the first ink. In addition, the control unit 11 acquires, in some manner, the color of the sheet P, which is the recording medium, in order to perform the determination of step S1211. For example, the control unit 11 queries the recording unit 20 a type of the sheet P set in the recording unit 20, and acquires the color of the sheet P in accordance with the type of sheet P notified from the recording unit 20 as a response to the query. Alternatively, the control unit 11 may input information indicating the color of the sheet P directly or indirectly from the user through the UI screen to acquire the color of the sheet P. The color of the sheet P is, for example, white, grey color near white, light yellow, etc. The control unit 11 can estimate the color of the sheet P from the type of sheet P.

When the color difference between the first ink and the sheet P is greater than or equal to a predetermined difference, the image processing unit 12*a* determines "No" in step S1211 and proceeds to step S122. The predetermined difference referred to here is a preset value. On the other hand, when the color difference between the first ink and the sheet P is less than the foregoing predetermined difference, the image processing unit 12*a* determines "Yes" in step S1211 and proceeds to step S126. In other words, when the color difference between the first ink and the sheet P is small, the color of the color boundary portion between the first ink and the second ink will appear to be thin, which is hardly recognized as image quality degradation. Further, copying the recording amount of the first ink to the target pixel has little effect on image quality improvement. Thus, when the image processing unit 12*a* determines "Yes" in step S1211, steps S122 to S125 are skipped. As a matter of realty, the color difference between the first ink and the recording medium is most likely to be determined to be small in step S1211 when the Y ink is set to the first ink among the CMYK ink.

4. SUMMARY

As described above, according to the present embodiment, the recording device 30 includes the recording unit 20 configured to discharge the plurality of colors of ink, and the control unit 11 configured to control the recording unit 20 to record the image on the recording medium. The control unit 11 is configured to perform the color expansion processing to copy, to the target pixel, the recording amount of the first ink included in the other pixel, the target pixel and the other pixel configuring the image data representing the image, the target pixel being adjacent to the other pixel, the other pixel including the recording amount of the first ink of the plurality of colors of ink, the target pixel including the recording amount of the second ink of the plurality of colors of ink, and cause the recording unit 20 to perform recording based on the image data after the color expansion processing. The target pixel does not include the recording amount of the first ink, and the second ink has a different color than the first ink. The expansion original pixel described heretofore is the other pixel.

According to the configuration, the recording amount of the first ink of the expansion original pixel is copied to the target pixel. As a result, in the recording result on the recording medium, a phenomenon in which the color boundary portion between the dot of the first ink and the dot of the second ink appears to be thin can be eliminated, as well as the color unevenness can be suppressed.

Additionally, according to the present embodiment, the control unit 11 may be configured to perform copying of the recording amount of the first ink to the target pixel when the recording amount of the first ink included in the other pixel is greater than or equal to the predetermined threshold value, and not to perform copying of the recording amount of the first ink to the target pixel when the recording amount of the first ink included in the other pixels is less than the threshold value.

According to the configuration, when the recording amount of the first ink of the expansion original pixel is small and therefore it is not too problematic that the color of the color boundary portion between the first ink and the second ink is thin, the above-mentioned processing of copying the recording amount of the first ink can be prohibited. This suppresses, as much as possible, the occurrence of the recording result that deviate from the color originally represented by the image data.

Additionally, according to the present embodiment, the control unit 11 may be configured to perform copying of the recording amount of the first ink to the target pixel when the color difference between the first ink and the recording medium is greater than or equal to the predetermined difference, and not to perform copying of the recording amount of the first ink to the target pixel when the color difference between the first ink and the recording medium is less than the predetermined difference.

According to the configuration, when the color of the color boundary portion between the first ink and the second ink appears thin, which is hardly recognized as image quality degradation, and the image quality improvement effect of the color expansion process is small, the above-mentioned processing of copying the recording amount of the first ink can be prohibited. As a result, the processing can be simplified and the increase in ink consumption can be suppressed.

In addition, according to the present embodiment, the control unit 11 may copy, in the color expansion process, a portion of the recording amount of the first ink included in the other pixel to the target pixel.

According to the configuration, the occurrence of the recording result that deviate from the color originally represented by the image data can be suppressed as much as possible.

In addition to the category of recording devices, the present embodiment discloses various categories of disclosures such as programs and methods. A recording method for performing recording of an image on a recording medium by controlling a recording unit 20 configured to discharge a plurality of colors of ink includes a color expansion step for copying, to the target pixel, the recording amount of the first ink included in the other pixel, the target pixel and the other pixel configuring the image data representing the image, the target pixel being adjacent to the other pixel, the other pixel including the recording amount of the first ink of the plurality of colors of ink, the target pixel including the recording amount of the second ink of the plurality of colors of ink, and a recording step for causing the recording unit 20 to perform recording based on the image data after the color expansion step, wherein the target pixel does not include the recording amount of the first ink, and the second ink has a different color than the first ink.

The timing of performing the color expansion processing of step S120 may be after the HT processing according to step S130, rather than between step S110 and step S130. The dot-on information included in the pixel means that the recording amount of the ink is present. That is, the image processing unit 12*a* is configured to perform the color expansion processing to copy, to the target pixel, the dot of the first ink included in the other pixel, the target pixel and the other pixel configuring the image data after the HT processing, the target pixel being adjacent to the other pixel, the other pixel including the dot of the first ink, the target pixel not including the dot of the first ink and including the dot of the second ink, and then proceed to step S140.

This embodiment can be said to be particularly effective in improving image quality when recording is performed using the UV ink. However, the present embodiments are of course applicable when using ink that is not the UV ink. The present embodiment is effective in all cases where the ink does not easily penetrate or bleed through the recording medium in a relationship between the ink and the recording medium.

What is claimed is:

1. A recording device comprising:

a recording unit configured to discharge a plurality of colors of ink; and a control unit configured to control the recording unit to perform recording of an image on a recording medium, wherein the control unit is configured to:

perform color expansion processing to copy, to a target pixel, a recording amount of first ink included in another pixel, the target pixel configuring image data representing the image and being adjacent to the other pixel, the other pixel including the recording amount of the first ink of the plurality of colors of ink, the target pixel including a recording amount of second ink of the plurality of colors of ink; and cause the recording unit to perform recording based on the image data after the color expansion processing;

before performing color expansion processing, the target pixel does not include the recording amount of the first ink; and the second ink has a different color than the first ink.

2. The recording device according to claim 1, wherein the control unit is configured:

to perform copying of the recording amount of the first ink to the target pixel when the recording amount of the first ink included in the other pixel is greater than or equal to a predetermined threshold value; and not to perform copying of the recording amount of the first ink to the target pixel when the recording amount of the first ink included in the other pixels is less than the threshold value.

3. The recording device according to claim 1, wherein the control unit is configured:

to perform copying of the recording amount of the first ink to the target pixel when a color difference between the first ink and the recording medium is greater than or equal to a predetermined difference; and not to perform copying of the recording amount of the first ink to the target pixel when the color difference between the first ink and the recording medium is less than the predetermined difference.

4. A recording method for performing recording of an image on a recording medium by controlling a recording unit configured to discharge a plurality of colors of ink, the method comprising:

a color expansion step for copying, to a target pixel, a recording amount of first ink included in another pixel, the target pixel configuring image data representing the image and being adjacent to the other pixel, the other pixel including the recording amount of the first ink of the plurality of colors of ink, the target pixel including a recording amount of second ink of the plurality of colors of ink; and a recording step for causing the recording unit to perform recording based on the image data after the color expansion step, wherein before the color expansion step, the target pixel does not include the recording amount of the first ink; and the second ink has a different color than the first ink.

* * * * *